US007001502B1

(12) United States Patent
Satchwell et al.

(10) Patent No.: US 7,001,502 B1
(45) Date of Patent: Feb. 21, 2006

(54) PROCESS FOR TREATING CRUDE OIL USING HYDROGEN IN A SPECIAL UNIT

(75) Inventors: Robert Satchwell, Sherwood Park (CA); Jose Lourenco, Edmonton (CA); Patrick J. Cochrane, Sherwood Park (CA); Roderick M. Facey, Edmonton (CA); Joao Rodrigues, Edmonton (CA); Kenneth Bannard, Drayton Valley (CA); Hannu Salokangas, Edmonton (CA)

(73) Assignee: Canadian Enviromnental Equipment & Engineering Technologies, Inc., Alberta (CA)

( * ) Notice: Subject to any disclaimer, the term of this patent is extended or adjusted under 35 U.S.C. 154(b) by 0 days.

(21) Appl. No.: 09/529,438

(22) PCT Filed: Sep. 29, 1999

(86) PCT No.: PCT/CA99/00914

§ 371 (c)(1),
(2), (4) Date: May 12, 2000

(87) PCT Pub. No.: WO00/18854

PCT Pub. Date: Apr. 6, 2000

(51) Int. Cl.
*C10G 65/02* (2006.01)
*C10G 45/02* (2006.01)

(52) U.S. Cl. ..... 208/59; 208/210; 208/212

(58) Field of Classification Search ..... 208/59, 208/210, 212
See application file for complete search history.

(56) References Cited

U.S. PATENT DOCUMENTS

| | | | | |
|---|---|---|---|---|
| 3,037,930 | A * | 6/1962 | Mason | 208/59 |
| 3,174,925 | A * | 3/1965 | Claussen et al. | 208/59 |
| 4,294,686 | A | 10/1981 | Fisher et al. | |
| 4,921,595 | A * | 5/1990 | Gruia | 208/59 |
| 5,069,775 | A | 12/1991 | Grosboll | |
| 5,133,941 | A | 7/1992 | Hays et al. | |
| 6,207,041 | B1 * | 3/2001 | Morel et al. | 208/89 |

FOREIGN PATENT DOCUMENTS

| | | |
|---|---|---|
| CA | 1191471 | 8/1985 |
| GB | 934907 | 8/1963 |
| GB | 1 232 172 | 5/1971 |
| GB | 1 326 265 | 8/1973 |
| GB | 2 145 426 A | 3/1985 |
| WO | WO98/59019 | 12/1998 |

* cited by examiner

*Primary Examiner*—Walter D. Griffin
(74) *Attorney, Agent, or Firm*—Swanson & Bratschun, L.L.C.

(57) ABSTRACT

A process is provided for treating crude oil to visbreak and/or upgrade such oil using hydrogen gas. The process includes the steps of introducing hydrogen into a heated stream of crude oil or partially upgraded crude oil and mixing such introduced hydrogen with the oil to achieve intimate dispersion of hydrogen to enhance thereby visbreaking and/or upgrading.

14 Claims, 1 Drawing Sheet

PROCESS FOR TREATING CRUDE OIL USING HYDROGEN IN A SPECIAL UNIT

FIELD OF INVENTION

This invention relates to the upgrading of crude oil by: (i) destructive hydrogenation which reduces its specific gravity and viscosity, and (ii) non-destructive hydrogenation which improves the product quality by removing sulfur, nitrogen, and oxygen.

BACKGROUND OF INVENTION

This invention finds application in treatment and upgrading of heavy crude oil and bitumen. These materials are commonly very viscous and dense liquid scontaining various concentrations of sulfur. Pipeline companies penalize heavy crude oil producers for the quality of crude oil produced. These penalties can result in price deductions from undesirable oil properties related to density, sulfur content, and viscosity.

A common practice by heavy oil producers is to add condensate (low boiling liquid hydrocarbon) to the produced crude oil to meet viscosity specifications for pipeline shipment. The requirement to add a condensate reduces the profit margin per barrel of oil produced. Another alternative is to treat and upgrade the crude oil before injecting it into pipelines. Current treatment and upgrading techniques have been shown to be only economically viable in large plant capacities. Furthermore, these technologies are based on producing a variety of products. One of the advantages of this invention is providing a method of minimizing and/or eliminating price deductions related to produced crude oil quality and focuses on producing a single product stream that can be transported via the pipeline in small and large plant capacities.

Upgrading and treatment technologies, such as described in U.S. Pat. Nos. 4,294,686 and 5,069,775 and Canadian Patent 1,191,471 can be classified as either: (i) carbon rejection processes, (ii) non-carbon rejection processes, or (iii) combinations of either processes. Carbon rejection processes are based on removing a portion of the crude oil as a solid or semi-solid substance called coke. Coke production is commonly accompanied with gases being produced from severe cracking reactions. Usually the impurities remain in the coke. Poor process economics are typical for carbon rejection processes because liquid yields are generally between 65% and 80%. Non-carbon rejection processes are commonly known as visbreaking (viscosity breaking—an operation to reduce), reforming, alkylation, polymerization, and hydrogen-refining methods. These non-carbon rejection processes result in liquid yields between 90% to 105%.

This invention is based on the following design criteria:

1. Small and large plant capacities that are of modular construction, which can be deployed at field production batteries to produce a single liquid product stream, and
2. A process designed to produce highly favorable process economics by (i) maximizing product yields, (ii) minimizing product viscosity, (iii) minimizing density, (iv) maximizing the removal of contaminants, (v) minimizing capital equipment costs, and (vi) minimizing processing costs.

Heavy crude oils are generally hydrogen deficient and are best amendable for treatment with hydrogenation processes. A hydrogenation process best satisfies the design criteria.

Hydrogenation processes for refining are classified as destructive or nondestructive techniques. Crude oil exists as homologous fractions that have boiling point ranges between 36° C. (97° F.) to 553° C. (1027° F.). The denser and larger boiling point fractions are composed of long chain hydrocarbons. To minimize density and viscosity, these long chain hydrocarbon need to be broken into fragments. The fragmentation is accomplished by cracking reactions. Generally, cracking reactions occur at temperatures above 343° C. (650° F.). Destructive hydrogenation is achieved by cracking the liquid hydrocarbon molecular bonds and accompanied by hydrogen saturation of the fragments to create stable lower boiling point products, such as described in Canadian patent 1,191,471. This technique employs moderate processing conditions and high-pressure hydrogen that minimizes polymerization and condensation which minimizes coking. Destructive hydrogenation processes generally are operated at pressures from 1,000 psi to 3,000 psi and at a temperature in the order of 538° C. (1000° F.). Non-destructive hydrogenation is generally used for the purpose of improving product quality without appreciable alterations of the boiling point range or density. Milder processing conditions are employed for the removal of undesirable products. These undesirable products include sulfur, nitrogen, oxygen, olefins, and heavy metals.

Other examples of upgrading and viscosity reduction processes involving the use of hydrogen at high temperatures and pressures and always under catalytic conditions are described in German application 1,933,857; Canadian patent 1,272,461; U.S. Pat. No. 3,598,722, and WO 97/29841.

SUMMARY OF INVENTION

The invention in accordance with an aspect therefore provides a method, which injects either, a low or high-pressure hydrogen containing gas treatment stream into either a low or high-pressure hydrocarbon stream. In the case of a low-pressure gas treatment stream being injected into a high-pressure hydrocarbon stream, the low-pressure stream is injected into the stream without the use of mechanical energy such as a gas injection pump or compressor, thereby reducing capital equipment costs. In the destructive hydrogenation step, the process provides a method of saturating the liquid hydrocarbon with hydrogen or other gases above normal saturation levels. An aspect of the process is to preheat the hydrogen and disperse the hydrogen or other gases at a near molecular level into the liquid hydrocarbon stream. These aspects and others allow the operating conditions to be less severe than conventional hydrogenation processes. These conclusions are supported with evidence as provided in the summary of experimental data.

In accordance with an aspect of the invention a process is provided for treating crude oil to reduce viscosity and/or upgrade such oil using hydrogen gas. The process comprises the steps of introducing a hydrogen containing stream to a heated stream of crude oil or partially upgraded crude oil and mixing such introduced hydrogen with the oil to achieve intimate dispersion of hydrogen molecules in said oil stream to provide hydrogenation reactions with oil hydrocarbons.

In accordance with another aspect of the invention, a process is provided for treating crude oil or partially upgraded crude oil to reduce viscosity and/or upgrade such oil using hydrogen treatment under reactive conditions, The process comprises:

i) heating feed stream of crude oil to about 38° C. (100° F.) to about 316° C. (600° F.) and introducing a side stream containing hydrogen to the feed stream and mixing the streams to achieve uniform dispersion of hydrogen molecules in the oil stream, dividing the mixed stream and introducing a minor stream to a primary vessel to achieve separation of volatile light ends from hydrotreated heavier ends and introducing a major portion to a stream returned from a primary hydrogen treatment zone and before introduction to the primary vessel to the quench hydrogen treatment and minimize coke production in the primary vessel, ii) removing light volatiles from the primary vessel and directing them to a secondary vessel for further separation, iii) removing heavy non-volatiles from the primary vessel and directing them to said primary hydrogen treatment loop where hydrogen is introduced to the stream of heavy non-volatiles, mixed and heated to an elevated temperature of about 343° C. (650° F.) to about 510° C. (950° F.) followed by additional mixing to enhance hydrogen reactions, returning the stream to the primary vessel with the introduction of the major portion of treated crude oil stream to quench any coke forming reactions before introduction to the primary vessel.

BRIEF DESCRIPTION OF THE DRAWINGS

Preferred embodiments of the invention are shown in the drawings wherein.

DETAILED DESCRIPTION OF PREFERRED EMBODIMENTS OF THE INVENTION

Figure 1:
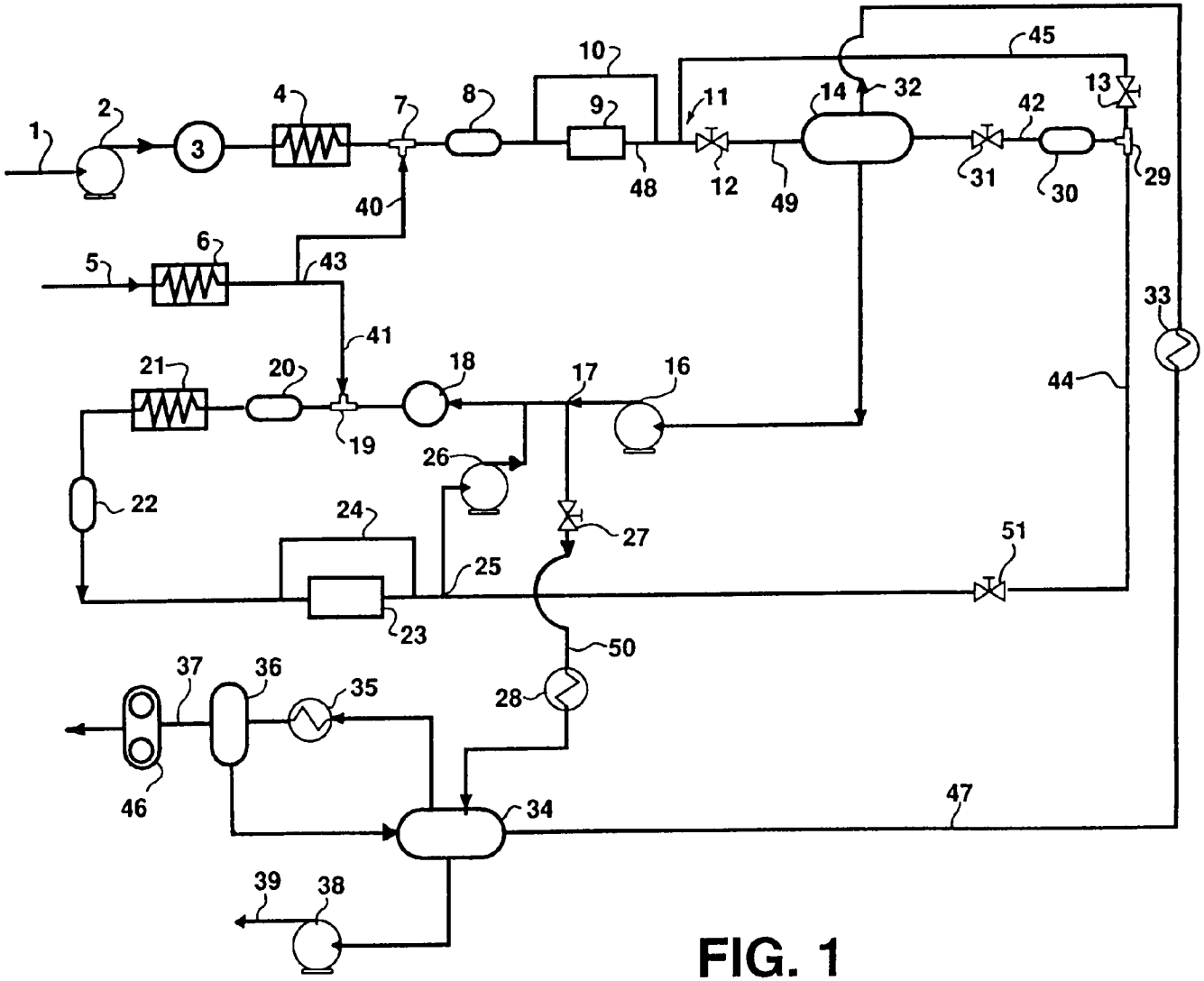
FIG. 1 is a flow diagram of the process in accordance with a aspect of the invention.

The markets available to use this invention may for example be regions that produce heavy oil. These include markets in Canada, Venezuela, United States, Africa, and other international production regions. One of the largest target market includes the field in Venezuela. The heavy oil reserves of the Oil Belt of Venezuela have been estimated to be 1.1 trillion barrels. An upgrading technology represents a tremendous market advantage in the heavy oil production regions of the world. The process of this invention is also capable of treating the crude oil stream to remove sulfur based compounds, nitrogen based compounds and metallic compounds. This invention also represents a significant improvement in conventional refining practices. Refineries could easily employ this technology to improve hydroprocessing techniques.

The features of this invention provide improved benefits in the upgrader process and higher quality product through destructive and non-destructive hydrogenation. Various aspects of the process provide several features and advantages, which include:

Improved hydrogenation through mixing to achieve saturation of the feed material with hydrogen, Improved removal of lighter hydrocarbons by saturating the feed materials with recycle gas made by the process (under reduced partial pressure and improved gas diffusion), Flashing and/or low pressure for removal of lighter components to increase the effectiveness of hydrogenation, The ability to operate at different operating temperatures and pressures to produce a desired product, Saturation of the undistilled portion of hydrocarbons with hydrogen (achieved by reducing the high-pressure limitations present in conventional hydrogenation and hence improved diffusion of hydrogen), Injection of hydrogen at low pressure into a high pressure hydrocarbon stream, Increased utilization of hydrogen (by minimizing hydrogen recycle and hydrogen addition rate), Control of recycle rates to provide higher quality products (by means of a variable-circulating ratio of undistilled to feed hydrocarbons), Control of residence time to provide higher quality products, Provide upgraded stable products, Saturation of hydrocarbons with hydrogen to improved product quality (achieved by removing sulfur, nitrogen, oxygen, and heavy metal components), Flexible operating pressures parameters to provide desired product condition.

Reduction of plant cost as compared to conventional processes (by limiting the size of the equipment for hydrogenating hydrocarbons).

As shown in FIG. 1, the raw crude oil containing less than 0.5 volume percent sediment and water is injected into the system through line 1 by use of a variable rate feed pump 2 operated at pressures between 100 psi to 2500 psi. A pulsation dampener 3 maintains constant pressure conditions downstream. The feed material is heated to relatively mild temperatures to maintain a constant temperature between 38° C. (100° F.) to 316° C. (600° F.) at the outlet of heater 4. Heating of the liquid hydrocarbon stream is accomplished by means of direct or indirect heating. Hydrogen-rich product gas which may be a by-product of the process (such as described in U.S. Pat. Nos. 4,294,686 and 5,069,775) may be recycled into the system through line 40 into what can be a venturi, inductor, eductor, injector, or tee at point 7 receiving preheated feed material from heater 4. A stream that is low pressure (i.e. less than 350 psi) is effectively induced into the liquid hydrocarbon stream by a venturi, inductor, or eductor. Whereas for high pressure (i.e. greater than 350 psi) the gas stream is effectively injected into the liquid hydrocarbon stream using a tee or injector. The two process streams are mixed to provide non-catalytic, non-destructive hydrogenation reactions using a mixing vessel or in line mixing device 8 to thoroughly mix and disperse one process stream into the other stream. The mixer functions to disperse the hydrogen into the oil stream at a highly efficient level to provide very fine bubbles in the oil stream. Such dispersion is usually at a saturation level and hence the reduced demand for hydrogen. Although it is understood that, depending on the type of mixer and the quantities of hydrogen, slightly less than saturation, or saturation may also be achieved. Normal prior art processes use 3 to 5 times the required amount, as taught for example in published PCT application WO97/29841 where about 2000 ft.$^3$ of $H_2$/barrel of oil to 10000 ft.$^3$ of $H_2$/1\barrel of oil. The process of this invention uses considerably less, usually in the range of 15% to 30% excess more than the stoichiometric amount. Following mixing, additional non-destructive hydrogenation is accomplished in catalyst vessel 9 filled with commercially available catalysts, such as described in Canadian patent 1,191,471 and WO97/29841. Catalyst vessel 9 may also serve to trap and remove any metals present in the raw feed material to protect the catalyst in vessel 23. The catalyst may also be housed in a reactor having a fixed bed, a mixing provision such as a stirred reactor, a fluidized bed or an ebullated bed to enhance distribution of the catalyst to enhance the catalytic conversion. If non-catalytic processes are only to be used, then catalyst vessel 9 can be by-passed using line 10. Following mixing, multiple flow patterns can be taken at point 11. Control valves 12 and 13 can be manipulated to maintain process conditions and optimize process performance of the system.

A primary vessel 14 provides a means of removing the vaporized gas components from the liquid hydrocarbon. A vacuum may be applied to vessel 14 to increase flash yields. After the hydrogenated hydrocarbon material introduced in line 42 has been flashed in vessel 14, the heavier ends are removed from vessel 14 through line 15 by the high pressure, high temperature, variable rate pump 16. Following pump 16, multiple flow patterns can be taken at point 17. A pulsation dampener 18 is used after pumps 16 and 26 to maintain constant pressure conditions. At point 17 the heavier ends can be discharged directly by control valve 27 into vessel 34 to achieve a desired treated feed material. Prior to entry into vessel 34 the treated quality oil in line 50 is cooled at heat removal device 28 and condensed in a secondary vessel 34. Alternatively, the stream can be and in most circumstances will be recycled for further hydroprocessing.

Hydrogen or hydrogen rich gases created from the process are introduced in line 5 and split after heating into lines 40 and 41. Process gases can be used to increase hydrogen utilization. Hydrogen introduced in line 5 can be supplied at pressures as low as 50 psi to as high as 2500 psi. Hydrogen or process gases are heated using heater 6 to maintain the gas temperature to minimize or prevent the cooling of hydrocarbon liquids that contact the gas stream. Following heating, multiple flow patterns can be taken at point 43 Heavier ends removed by pump 16 are hydrogenated in the mixing vessel or in line mixing device 20 by introduction of hydrogen or process gases in line 5 at point 19. The gas and liquid streams are combined at 19 using a venturi, inductor, eductor, injector, or tee. A low-pressure gas stream (less than 350 psi) is effectively induced into the liquid hydrocarbon stream by a venturi, inductor, or eductor. Where as high pressure gas stream (greater than 350 psi) is effectively injected into the liquid hydrocarbon stream using a tee or injector. The mixing vessel or in line mixing device 20 is designed to mix and disperse a gas phase with a liquid phase to provide non-catalytic, non-destructive hydrogenation reactions. Following hydrogenation of the heavier ends the stream is heated using heater 21. The heat-input device 21 is used to increase the temperature of the combined stream from 20 to a set point between 343° C. (650° F.) to 510° C. (950° F.). Heater 21 also provides for cracking of heavier hydrocarbon components into smaller components. Maintaining pressures above 350 psi within this line and the addition of hydrogen to stream 15 eliminates plugging of heater 21 due to coking. Following heating additional mixing is provided by the mixing vessel or in line mixing device 22. The mixing vessel or device 22 is designed to mix and disperse a gas phase with a liquid phase and to provide non-catalytic, destructive hydrogenation reactions. Inserted after this mixing step is catalyst vessel 23 for additional destructive hydrogenation. If non-catalytic processes are only to be used then catalyst vessel 23 can be by-passed using line 24. Multiple flow patterns are provided for in the system at point 25. The stream can be recycled in this primary hydrogen treating loop using the high pressure, high temperature, variable rate pump 26 designed for a two-phase stream. Pump 26 can be used to change the residence time of the static mixers or devices 20 and 22 during the destructive hydrogenation step.

In accordance with this invention the hydrogen gas or hydrogen rich gases in lines 40 and 41 and the treated quenching stream in line 45 can be injected at low or high pressure into the respective high pressure hydrocarbon stream to be further treated. The injection process is capable of injecting a gas or other type of fluid at very low pressures relative to the main hydrocarbon stream pressure and at the same time achieve excellent mixing at near molecular level. This aspect of the invention may be accomplished by any suitable means, which by use of a mixer is capable of saturating the main stream with the treatment gas above normal saturation levels and doing so at lower temperature than conventional temperatures. For example, a suitable venturi, inductor, or eductor may be used at each injection point.

Hydrogen gas injection provides the benefits of non-destructive hydroprocessing and the increased flashing through stripping. Improved flashing in vessel 14 may be achieved by use of a blower 46 or other suitable pump in line 37. Optionally a blower 46 is provided to draw a vacuum in the vessel 34, which in turns draws a vacuum in lines 32 and 47 on into vessel 14. The feed material exits treatment at 48 and into a tee at 11 where the flow is partitioned into two streams at lines 45 and 49. Two control valves 12 and 13 maintain the flow volume through tee 11. Signals to these control valves are provided by pressure and temperature measurements. These control valves maintain the pressure on the upstream hydrocarbons in line 48 and provide a method of quenching the hot hydrocarbons exiting the hydrogenation process in line 44.

Vessel 14 can be operated at about atmospheric pressure or under a vacuum to remove the lighter ends that may interfere with the hydrogenation step. Operating the vessel at about atmospheric pressure is a significant advantage over prior art processes because the vessel does not have to meet pressurized vessel codes. The hydrocarbon liquids are recycled by pump 16 from the flash step into the hydrogenation step at desired ratios as compared to the feed pump rate. Pressure is maintained on the system by the use of control valves 31 and 51. Chemical reactions in line 44 are quenched at process point 29 by the introduction of the major preheated feed stream 45 to prevent the formation of coke. The quenched stream is mixed using mixing vessel or an in line mixing device 30 designed to mix a colder liquid phase with a warmer liquid phase that is capable of providing non-catalytic, destructive hydrogenation reactions. Large portions of the heavier ends that are not flashed in vessel 14 are recycled through pump 16 to provide further hydroprocessing or exit the system through line 50. Lighter ends from flashing in vessel 14, normally operated at about 500° F., are removed by line 32 where the product is condensed and cooled using heat exchanger 33 and discharged into vessel 34. Mist and entrained liquids from vessel 34 are condensed and cooled in heat removal device 35 and captured in vessel 36. Liquids that are condensed in vessel 36 are returned to vessel 34. The combined product streams condensed in or collected in vessel 34 are cooled and collected using variable-rate transfer pump 38 to provide product in line 39. The hydrogen rich hydrocarbon gas stream in line 37 may be used as treatment gas in line 5.

SUMMARY OF EXPERIMENTAL DATA

An example of process data using the invention described herein is provided. Typically, to achieve significant viscosity reductions and increases in API gravity, conventional processing temperatures between 454° C. (850° F.) to 510° C. (950° F.) are employed. As a result of using the invention described herein, Table 1 shows significant viscosity reductions and lighter product materials produced by this invention under very mild operating conditions with processing temperatures not exceeding 402° C. (755° F.). Compared to prior art process which require catalyst, operating pressures usually in excess of 2000 psi and operating temperatures 482° C. (900° F.) or more. The feed stock was an Alberta heavy crude oil and relative to these analyses, had an average API gravity of 12.7 and viscosity of 3808 cP @ 20° C. (68° F.).

TABLE 1

An Example of Preliminary Product Analyses obtained from the Invention

| Temperature ° F. | API increase % | Viscosity Reduction[1] % |
|---|---|---|
| 735 | N/A | 13.94 |
| 745 | 0.79 | 36.73 |
| 750 | 4.00 | 50.75 |
| 755 | 9.37 | 67.88 |

N/A-not available
1-Measured at 20° C. (68° F.)

Various embodiments of the invention have been described herein in detail. It is appreciated by those skilled in the art that variations may be made thereto without departing from the spirit of the invention or the scope of the appended claims.

What is claimed is:

1. A process for treating crude oil or partially upgraded crude oil to reduce viscosity or upgrade such oil using hydrogen treatment under reactive conditions, said process comprising:

i) heating feed stream of crude oil to about 38° C. to about 316° C. and introducing to said feed stream a first heated side stream containing hydrogen, and mixing said feed and side streams to produce a mixed stream having uniform dispersion of hydrogen molecules in said mixed stream;

ii) dividing said mixed stream into a minor mixed stream and a major mixed stream, introducing said minor mixed stream to a primary separating vessel to achieve separation of volatile light ends from hydrotreated heavier ends;

iii) introducing to said major mixed stream, prior to entry into said primary vessel, a mixed heavy stream returned from a primary hydrogen treatment zone to quench hydrogen treatment and minimize coke production in said primary vessel;

iv) removing volatiles from said primary vessel and directing them to a secondary vessel for further separation;

v) removing heavy non-volatiles from said primary vessel and directing said heavy non-volatiles to a primary hydrogen treatment loop where a second heated side stream containing hydrogen is introduced and mixed into said heavy non-volatiles to produce said mixed heavy stream, said mixed heavy stream being heated to an elevated temperature of about 343° C. to about 510° C. followed by additional mixing to enhance hydrogen reactions; and vi) combining said mixed heavy stream with said major mixed stream prior to entry into said primary vessel to quench any coke forming reactions before introduction to said primary vessel.

2. A process of claim 1, wherein a minor portion of said heavy non-volatiles from said primary vessel is introduced to said secondary vessel.

3. A process of claim 1, wherein a portion of said heavy non-volatiles in said primary hydrogen treatment loop is recycled in said loop for further treatment before delivery to said primary vessel.

4. A process of claim 1, wherein optional catalyst treatment is provided downstream of each point of hydrogen introduction to enhance hydrogenation of cracked hydrocarbons.

5. A process of claim 1, wherein at least one of said first and second side streams containing hydrogen are introduced at pressures ranging from about 50 psi to about 2500 psi.

6. A process of claim 1, wherein said primary hydrogen treatment loop comprises a pump with a dampener to recycle a portion of said mixed heavy stream for further upgrading.

7. A process of claim 4, wherein said catalyst is provided in a fixed bed or a stirred reactor, a fluidized bed reactor or an ebullated catalyst bed reactor.

8. A process of claim 1, wherein said primary vessel is operated at about 500° F. to flash off light hydrocarbons.

9. A process of claim 1, wherein said first and second side streams containing hydrogen are introduced to provide a stoichiometric excess of hydrogen of up to 30%.

10. process of claim 1, wherein said primary and secondary vessels are operated at a vacuum relative to atmospheric pressure.

11. A process of claim 10, wherein valves are provided upstream and downstream of each said vessel to permit the vessels to operate at said vacuum.

12. A process of claim 1, wherein a blower is provided downstream of said secondary vessel to draw off said volatile light ends and develop a vacuum in said primary vessel to enhance flashing off of light ends.

13. A process of claim 1, wherein said introducing to said feed stream a first heated side stream containing hydrogen removes sulphur-based compounds, nitrogen-based compounds and metallic compounds.

14. A process of claim 1, wherein said primary hydrogen treatment loop is maintained at a pressure above 350 psi to minimize coking at said elevated temperature where cracking, hydrogenation, or both, of hydrocarbons occur.

* * * * *